United States Patent [19]

Pask

[11] 4,092,826

[45] June 6, 1978

[54] FUEL INJECTORS FOR GAS TURBINE ENGINES

[75] Inventor: George Pask, Stanton-by-Bridge, England

[73] Assignee: Rolls-Royce Limited, London, England

[21] Appl. No.: 746,016

[22] Filed: Nov. 30, 1976

[30] Foreign Application Priority Data

Dec. 6, 1975 United Kingdom ..... 50130/75

[51] Int. Cl.[2] ..... F02C 7/22

[52] U.S. Cl. ..... 60/39.74 R; 239/400; 239/404; 239/406

[58] Field of Search ..... 60/39.71, 39.74 R, 39.74 B; 239/400, 402, 403, 404, 405, 406

[56] References Cited

U.S. PATENT DOCUMENTS

| | | | |
|---|---|---|---|
| 3,667,221 | 6/1972 | Taylor | 60/39.74 R |
| 3,736,746 | 6/1973 | DuBell et al. | 60/30.74 R |
| 3,808,803 | 5/1974 | Salvi | 60/39.74 R |
| 3,811,278 | 5/1974 | Taylor et al. | 60/39.74 R |
| 3,915,387 | 10/1975 | Caruel et al. | 239/404 |
| 3,980,233 | 9/1976 | Simmons et al. | 239/404 |

FOREIGN PATENT DOCUMENTS

| | | | |
|---|---|---|---|
| 937,531 | 4/1948 | France | 239/404 |

*Primary Examiner*—Robert E. Garrett
*Attorney, Agent, or Firm*—Cushman, Darby & Cushman

[57] ABSTRACT

An airspray burner is supplied with fuel tangentially through a port and the upstream end of the burner is provided with a helical wall to prevent the fuel from passing back out of the fuel delivery port.

6 Claims, 5 Drawing Figures

FUEL INJECTORS FOR GAS TURBINE ENGINES

This invention relates to fuel injectors for gas turbine engines.

A particular problem with a typical fuel injector is that it is provided with integral fuel supply ducts which results in a rather bulky assembly. Inserting and withdrawing the injector into and out of the engine necessitates the provision of large holes in the various engine casings surrounding the combustion chamber, through which the whole injector assembly must be passed and then manoeuvred so that the injector can be correctly located in position in the end of the flame tube.

Various attempts have been made to overcome this problem such as by providing separate fuel ducts which can be simply inserted into an injector already mounted in position in the flame tube. Further problems have arisen with this arrangement however, typically the problem of sealing the ends of the fuel supply ducts where they meet the injector. Most modern fuel injectors are adapted to swirl the fuel into a rotating annulus adjacent to the wall of the injector and the fuel is thus capable of passing radially out of the injector body through any poor joints or seals therein. It is an object of the present invention to eliminate or at least reduce this tendency.

According to the present invention a fuel injector for a gas turbine engine comprises a hollow body which is adapted to be supplied with compressed air, means for swirling at least a portion of the compressed air, the wall of the hollow body being provided with an orifice adapted to receive the end of a fuel supply duct, means being provided in the hollow body to deflect fuel supplied thereto from the orifice to a location downstream of the orifice to prevent the fuel from returning outwardly through the orifice.

Preferably the hollow body is circular in cross-section and is adapted to receive fuel tangentially from the fuel supply duct.

The means for deflecting the fuel downstream of the orifice preferably comprises a substantially helically shaped wall formed on the internal surface of the hollow body.

The orifice preferably is larger than the end of the fuel supply duct whereby to define a flow passage therebetween for the passage of compressed air into the hollow body.

A further cylindrical body may be provided inside the hollow body to define an annular passage into which the fuel and air passes, the substantially helically shaped wall extending across the width of the annular passage.

Preferably an outer body which at least partly surrounds the hollow body is provided and defines an air flow passage therebetween.

The invention also comprises a gas turbine engine having a fuel injector as set forth above.

Figure 1:
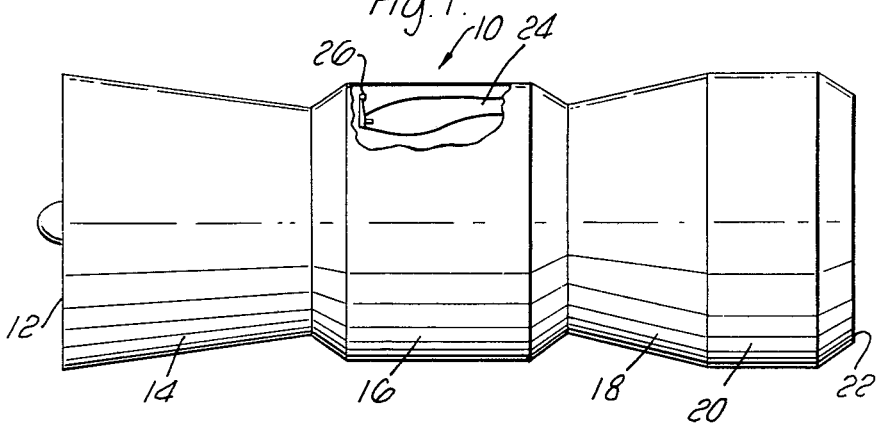
Figure 3:
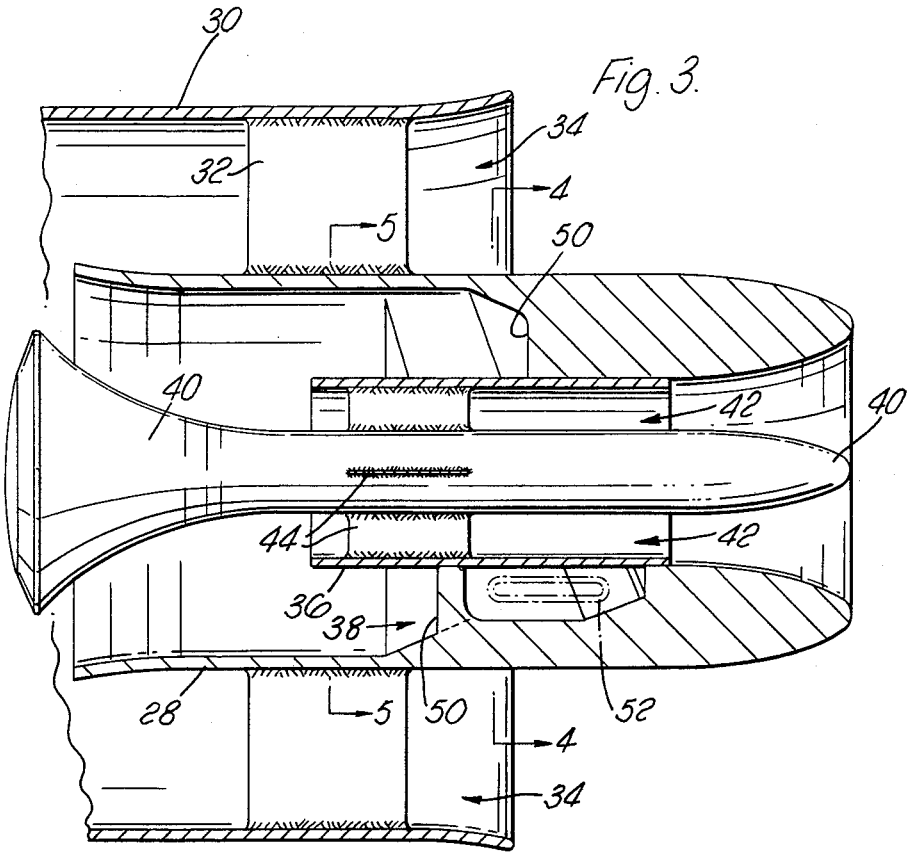
Figure 2:
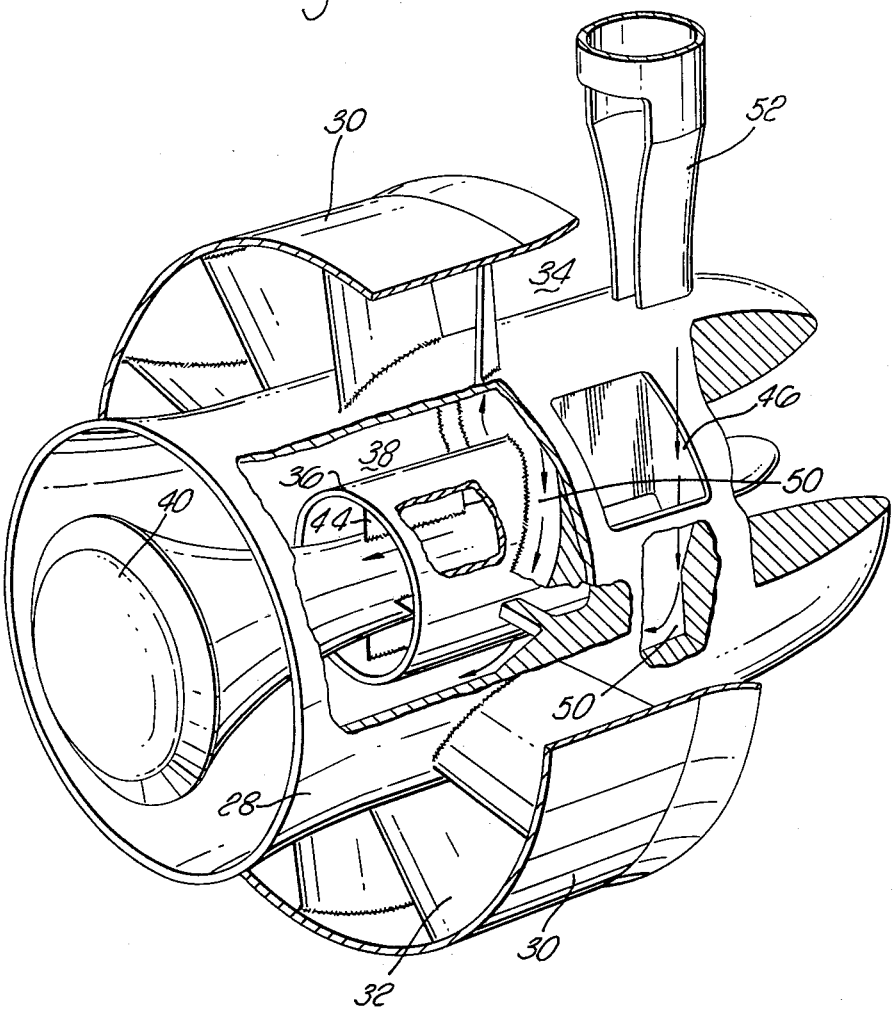
Figure 4:
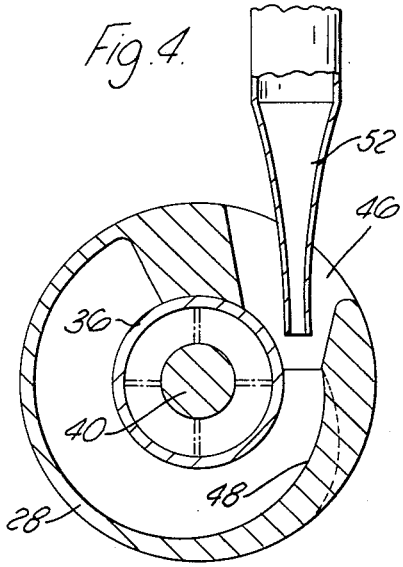
Figure 5:
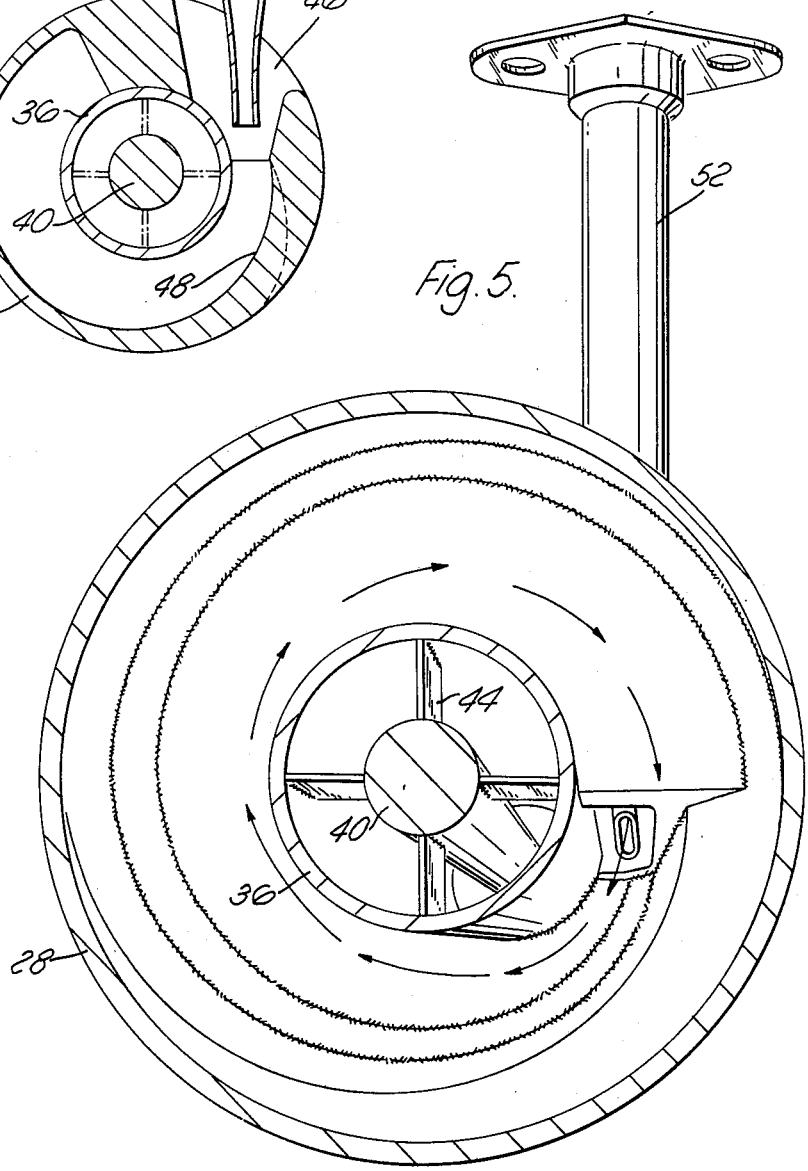

An embodiment of the invention will now be described by way of example only in which:

FIG. 1 shows a gas turbine engine provided with a fuel injector according to the invention, FIG. 2 is a cutaway perspective view of a fuel injector according to the present invention, the view showing the fuel supply pipe or duct prior to its being received in the orifice in the hollow body, FIG. 3 is a longitudinal cross-sectional view of the fuel injector, FIG. 4 is a view of the fuel injector from line 4—4 in FIG. 3 and FIG. 5 is a view of the fuel injector from line 5—5 in FIG. 3.

In FIG. 1 there is shown a gas turbine engine 10 having an air intake 12, compressor means 14, combustion equipment 16, turbine means 18, a jet pipe 20 and an exhaust nozzle 22.

The combustion equipment comprises a combustion chamber 24, at the upstream end of which is mounted a fuel injector 26. The fuel injector 26 comprises basically an elongated hollow cylindrical body 28 and an outer shroud ring 30 which defines an annular passageway 34 and which is spaced from the body 28 by a plurality of swirl vanes 32. The upstream end of the body 28 (the right side in FIGS. 2 and 3) is streamlined and adapted to receive a flow of compressed air from the compressor means 14.

Located inside the body 28 is a cylindrical sleeve 36 which defines an annular passage 38 between it and the interior of the body 28, and located inside the sleeve 36 and extending the full length of the injector 26 is a pintle 40 which defines an annular flowpath or passage 42 between it and the sleeve 36. The pintle is spaced from the sleeve 36 and supported within it by vanes 44. The vanes 44 can be straight, as shown, or be shaped to impart a swirl to the compressed air.

Formed in the side or wall of the body 28 intermediate the hollow body's upstream and downstream ends is a hole 46 defining an orifice which communicates with the annular passage 38 substantially tangentially thereto, the inside wall 48 of the body 28 from the hole or orifice 46 being formed as an archimedean spiral. The annular passage 38 is provided with a rear wall 50 which is helical in form, starting upstream of the hole or orifice 46 and extending substantially 360° around the passage 38, over which angle the wall 50 is displaced to a position downstream of the hole or orifice 46 as clearly shown in FIGS. 3 and 5.

Adapted to project into the hole or orifice 46 is a fuel supply pipe 52 leaving a substantially annular gap between it and the walls of the hole 46. Alternatively a seal could be used between the pipe 52 and the hole 46.

In operation of the injector, compressed air passes through the passageway 34 and through the flowpath 42. A portion of the air also passes through the hole or orifice 46, around the helical wall 50 and into the passage 38. Fuel is injected by the pipe or duct 52 into the hole or orifice 46 to produce a swirling mass of fuel and air in the passage 38. The helical wall 50 prevents any of this fuel and air mixture passing radially back out of the hole 46 and thus a rotating annulus of fuel and air is produced on the inside of the body 28. At the downstream end of the central body 28 this annulus of fuel and air mixture breaks away from the edge of the interior surface of the body 28 between the flows of compressed air passing through the passageway 34 and through the annular flow path or passage 42, and the shearing effect between these two flows causes atomisation of the fuel into a substantially conical shape which issues into the combustion chamber 24.

With this arrangement the injector 26 can be made an integral part of the combustion chamber 24 and the fuel supply ducts 52 can be made from relatively simple pipes.

Thus the problem of inserting a complete assembly of fuel supply ducts and an injector into position in the end of a combustion chamber is removed. The injector can be made as an integral part of the combustion chamber and the fuel supply pipes 52 only may be made removable, thus permitting the provision of smaller holes through the engine casings and permitting easier sealing between the casings and the supply pipes.

Greater freedom of design of the injector is also obtained since it can be made more streamlined and longer and an improved airflow to the combustion chamber can be provided.

I claim:

1. A fuel injector for a gas turbine engine comprising: an elongated cylindrical hollow body having a downstream end, an upstream end and an interior surface opening at least to said downstream end; means defining a passage through the fuel injector for flow of compressed air; an orifice extending through the side of said hollow body intermediate the downstream end and the upstream end thereof and opening through said interior surface to the interior of the hollow body; a fuel supply duct extending into said orifice from the exterior of the hollow body and communicating with the interior of said hollow body through said orifice to supply fuel tangentially onto the interior surface of said hollow body, and a continuous helical wall projecting radially inwardly from said interior surface from a position immediately upstream of said orifice and extending at least 360° around said interior surface to a position downstream of said orifice whereby fuel supplied through said fuel supply duct is prevented from returning outwardly through said orifice.

2. A fuel injector as claimed in claim 1 wherein said means defining a passage for flow of compressed air through said fuel injector includes a further cylindrical hollow body positioned within said hollow body and spaced from the interior surface thereof, said further cylindrical hollow body defining with said interior surface an annular passage into which fuel passes. A

3. A fuel injector as claimed in claim 2 wherein said continuous helical wall extends across the width of said annular passage.

4. A fuel injector as claimed in claim 1 including an outer body at least partially surrounding and spaced from said hollow body and defining the passage for flow of compressed air through the fuel injector.

5. A fuel injector as claimed in claim 1 in which said interior surface of said hollow body is an Archimedean spiral in at least an area of said continuous helical wall.

6. A fuel injector as claimed in claim 1 wherein said orifice is larger than the end of said fuel supply duct whereby to define a flow passage therebetween for the passage of compressed air into said hollow body.

* * * * *